US011284710B1

(12) United States Patent
Guo

(10) Patent No.: US 11,284,710 B1
(45) Date of Patent: Mar. 29, 2022

(54) ADJUSTMENT DEVICE THAT CONTROLS A TILTING ANGLE OF A TABLE TOP

(71) Applicant: Foshan Nanhai Longshang Office Furniture Co., Ltd., Guangdong (CN)

(72) Inventor: Hongsheng Guo, Guangdong (CN)

( * ) Notice: Subject to any disclaimer, the term of this patent is extended or adjusted under 35 U.S.C. 154(b) by 0 days.

(21) Appl. No.: 17/098,428

(22) Filed: Nov. 15, 2020

(51) Int. Cl.
*A47B 13/08* (2006.01)
*A47B 13/02* (2006.01)

(52) U.S. Cl.
CPC ..... *A47B 13/081* (2013.01); *A47B 2013/025* (2013.01); *A47B 2200/0043* (2013.01)

(58) Field of Classification Search
CPC ..... A47B 2200/0043; A47B 2200/0042; Y10S 248/923
USPC ..... 108/6, 10, 1, 8; 248/371, 398, 133
See application file for complete search history.

(56) References Cited

U.S. PATENT DOCUMENTS 493,605 A * 3/1893 Tiffany ..... A47B 27/02 108/10
540,434 A * 6/1895 Gilfillan ..... A47B 27/02 108/10
3,358,620 A * 12/1967 Parigi ..... A47B 27/14 108/6
4,703,700 A * 11/1987 Sema ..... A47B 9/00 108/10
5,131,333 A * 7/1992 Karasawa ..... A47B 19/06 108/1
5,915,659 A * 6/1999 Scannell, Jr. ..... A47B 9/08 248/371
5,992,810 A * 11/1999 Crinion ..... A47B 21/0314 108/147
6,354,227 B1 * 3/2002 Feldpausch ..... A47B 37/02 108/10
6,883,439 B1 * 4/2005 Moore ..... A47B 9/10 108/147
7,677,184 B2 * 3/2010 Dhanoa ..... A47B 3/0812 108/115
8,020,816 B2 * 9/2011 Laitila ..... F16M 11/10 248/125.7
10,182,648 B1 * 1/2019 Lai ..... A47B 9/20
D921,408 S * 6/2021 Bergsma ..... D6/708.17
2003/0094123 A1 * 5/2003 Ulmer ..... A47B 13/023 108/10
2006/0016945 A1 * 1/2006 Taylor ..... F16M 11/28 248/188.5
2007/0090250 A1 * 4/2007 O'Keene ..... F16M 13/02 248/299.1

(Continued)

*Primary Examiner* — Jose V Chen
(74) *Attorney, Agent, or Firm* — Prakash Nama; Global IP Services, PLLC

(57) ABSTRACT

An adjustment device, having a tilting piece at a top front portion of a shell and rotates about a top front edge of the shell; a gear is at one side of the shell and fixedly connected to one side of the tilting piece, and is rotatable synchronously with the tilting piece; a position limiting piece is provided at a rear side of the gear, and is capable of engaging with the gear; a driving piece is provided in an inclined manner inside the shell; the driving piece and the position limiting piece are connected through a driving rod that passes through an inner side wall of the shell and drives the position limiting piece to move; a far end of the driving piece is connected with one end of a control string; another end of the control string is extended out of the shell to be pulled or released.

4 Claims, 2 Drawing Sheets

(56) References Cited

U.S. PATENT DOCUMENTS

| | | | | |
|---|---|---|---|---|
| 2012/0073476 | A1* | 3/2012 | Lai | A47B 41/02 108/2 |
| 2014/0182488 | A1* | 7/2014 | Lu | A47B 27/16 108/6 |
| 2019/0142153 | A1* | 5/2019 | Zunkeler | A47B 13/06 108/13 |
| 2019/0335924 | A1* | 11/2019 | Speagle | F16M 11/08 |
| 2021/0068531 | A1* | 3/2021 | Tao | A47B 13/003 |

* cited by examiner

ADJUSTMENT DEVICE THAT CONTROLS A TILTING ANGLE OF A TABLE TOP

BACKGROUND OF THE INVENTION

The present invention relates to the technical field of furniture, and more specifically relates to an adjustment device that controls a tilting angle of a table top.

A table top of a rostrum is generally fixed and unmovable, in other words, its tilting angle cannot be freely adjusted. Therefore, the size of the rostrum cannot be changed, and this causes trouble to transportation and carrying. Also, speakers in need of specific tilting angles of the table top cannot be satisfied.

To solve the problem of non-adjustable tilting angle of a table top, CN201734159U discloses an angle adjustment device for table top. With reference to paragraph 0012 of said CN patent, the angle adjustment device comprises a U-shaped supporting arm 1, a supporting seat 2 and a supporting rod 3; one end of the U-shaped supporting arm 1 rotatably coupled to a table top fixing seat 7; another end of the U-shaped supporting arm 1 is rotatably coupled to a rear end of the supporting seat 2; the supporting seat 2 is a U-shaped groove, and a plastic slider 4 is provided inside the U-shaped groove; the plastic slider 4 is slidable back and forth stably in the U-shaped groove along the inner walls of the U-shaped groove; two opposite side walls of the supporting seat 2 are provided with ratchet tooth racks respectively and the two ratchet tooth racks correspond to each other; one end of the supporting rod 3 is rotatably coupled to a middle portion of the U-shaped supporting arm 1, and another end of the supporting rod 3 is provided with a ratchet tooth connector 6; the ratchet tooth connector 6 passes through the plastic slider 4 disposed inside the U-shaped groove of the supporting seat 2; a middle portion of the plastic slider 4 is provided with a hole having a specific shape; the hole is provided with two locking spaces to accommodate the ratchet tooth connector, one locking space located at an upper portion of the hole and another locking space located at a lower portion of the hole; during an extending condition, the ratchet tooth connector is located at a first position 10 in the hole; during a retracting condition, the ratchet tooth connector is located at a second position 11 in the hole; accordingly, the ratchet tooth connector 6 can attain two different conditions, namely the extending condition and the retracting condition. The angle adjustment device for table top provided by said CN patent is very inconvenient to use. For every angle adjustment, the ratchet tooth connector has to be actuated by a finger to switch positions repeatedly between the two locking spaces in the hole of the plastic slider. In case of improper operation, the U-shaped supporting arm 1 that supports the table top fixing seat will fall and hurt the user. Further, the angle to be adjusted is limited by the lengths of the supporting seat 2 and the supporting rod 3 as well as the number of ratchet teeth on the ratchet tooth racks. For example, when only one said angle adjustment device is used, the supporting seat 2 and the supporting rod 3 cannot be too long, otherwise the stability of the table top will be poor. Besides, the number of ratchet teeth on the ratchet tooth racks will affect the fineness of the adjustment. Moreover, in case two said angle adjustment devices are used symmetrically, installation will become very inconvenient, and the two angle adjustment devices may not be symmetrically installed in case the user is unfamiliar with installation, which may then result in a table top having an uneven plane surface and the problem of non-smooth angle adjustment.

BRIEF SUMMARY OF THE INVENTION

In view of the aforesaid problems of complicated structure and operation, inconvenient installation, as well as uneven plane surface of the table top, the lack of fineness in adjustment and non-smooth angle adjustment in the prior art angle adjustment device for table top, the present invention provides an adjustment device that controls a tilting angle of a table top. The present invention is simple to operate and has improved fineness and smoothness of angle adjustment.

To fulfill the above objects of the present invention, the present invention provides an adjustment device that controls a tilting angle of a table top, comprising a shell, a tilting piece, a gear, a position limiting piece and a driving piece; the tilting piece is provided at a top front portion of the shell and rotates about a top front edge of the shell; the gear is provided at one side of the shell; the gear is fixedly connected to a side portion of the tilting piece, and is rotatable synchronously with the tilting piece; the position limiting piece is provided at a rear side of the gear, and is capable of engaging with the gear; the driving piece is provided in an inclined manner inside the shell; the driving piece and the position limiting piece are connected through a driving rod; the driving rod also passes through an inner side wall of the shell corresponding to the side of the shell where the gear and the position limiting piece are provided, and the driving rod drives the position limiting piece to move; a far end of the driving piece with respect to the side of the shell where the gear and the position limiting piece are provided is connected with one end of a control string; another end of the control string is extended out of the shell so as to be pulled or released. In the present invention, engagement between the position limiting piece and the gear is mainly controlled by pulling and releasing of the control string. When the position limiting piece is disengaged from the gear, the gear and the tilting piece can rotate synchronously so that the table top which is connected with the tilting piece can be adjusted to a suitable angle according to the need of the user. When adjustment is done, let the position limiting piece to engage with the gear again to prevent the rotation of the gear and the tilting piece so as to lock the table top at the adjusted tilting angle. The present invention is quick and easy to operate.

Further, said another end of the control string is provided with a string control handle; the string control handle comprises a hand-held portion; a press portion is connected to the hand-held portion to allow finger operation of the string control handle. The hand-held portion and the press portion facilitate cooperative force between the palm and fingers of the user such that the force applied is uniform and the pulling of the control string can be more effort-saving.

Further, the tilting piece has a sectional shape of an inverted U-shape. The inverted U-shape facilitates the tilting piece to be formed as an integral piece, thus preventing unnecessary processing and additional components. Also, the inverted U-shape provides a wider supporting surface so that the table top can be placed more stably and securely.

Further, one side of the shell is provided with a press handle; a bottom part of the shell is connected with a pneumatic cylinder; a top side of the pneumatic cylinder is provided with a touch switch which is positioned inside the shell when the shell and the pneumatic cylinder are connected; the touch switch corresponds to one end of the press handle such that the press handle controls touching of said end of the press handle with the touch switch. The pneumatic cylinder can suitably adjust the height of the adjustment device. The pneumatic cylinder and the adjustment device together can satisfy the needs of speakers of different heights.

Further, a bottom part of the pneumatic cylinder is connected to a supporting base; the supporting base has four legs separated from one another, and each of the four legs is provided with an omnidirectional wheel. The legs separated from one another can ensure more stable support of the adjustment device. The omnidirectional wheels allow the adjustment device to be moved from where it is situated, thus increasing the mobility of the adjustment device.

Compared with the prior art, the present invention has a simple structure, and is quick and easy to use. The user can quickly adjust the tilting angle of the table top by simply pulling the control string. During adjustment, user's hands are not required to directly access to the adjusting mechanism at the shell of the adjustment device, thereby preventing possible injuries. Also, angle adjustment by means of the gear and the tilting piece can improve the fineness and smoothness of the adjustment, and provides more stable and secured support of the table top.

DETAILED DESCRIPTION OF THE INVENTION

Figure 1:
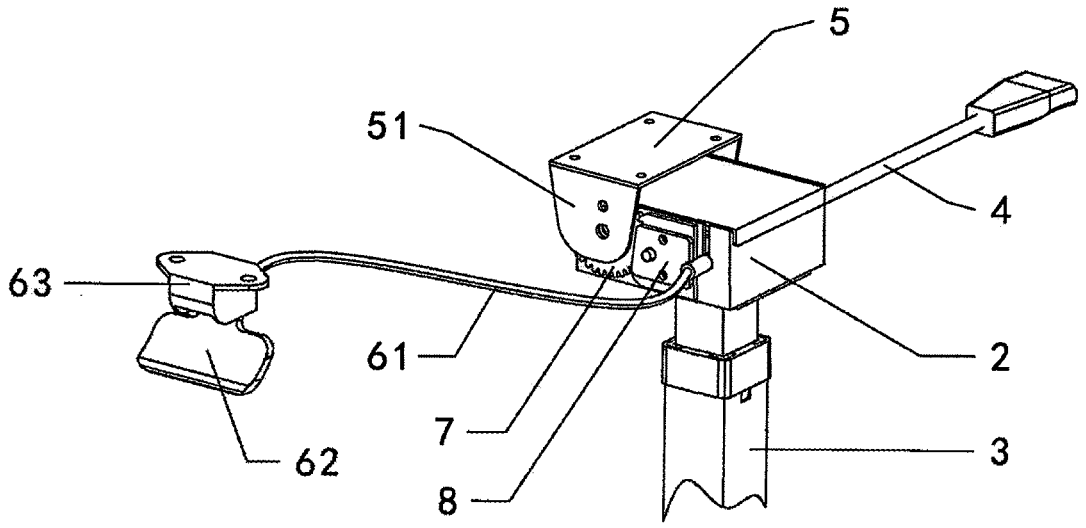
FIG. 1 is a schematic structural view of the present invention.
Figure 2:
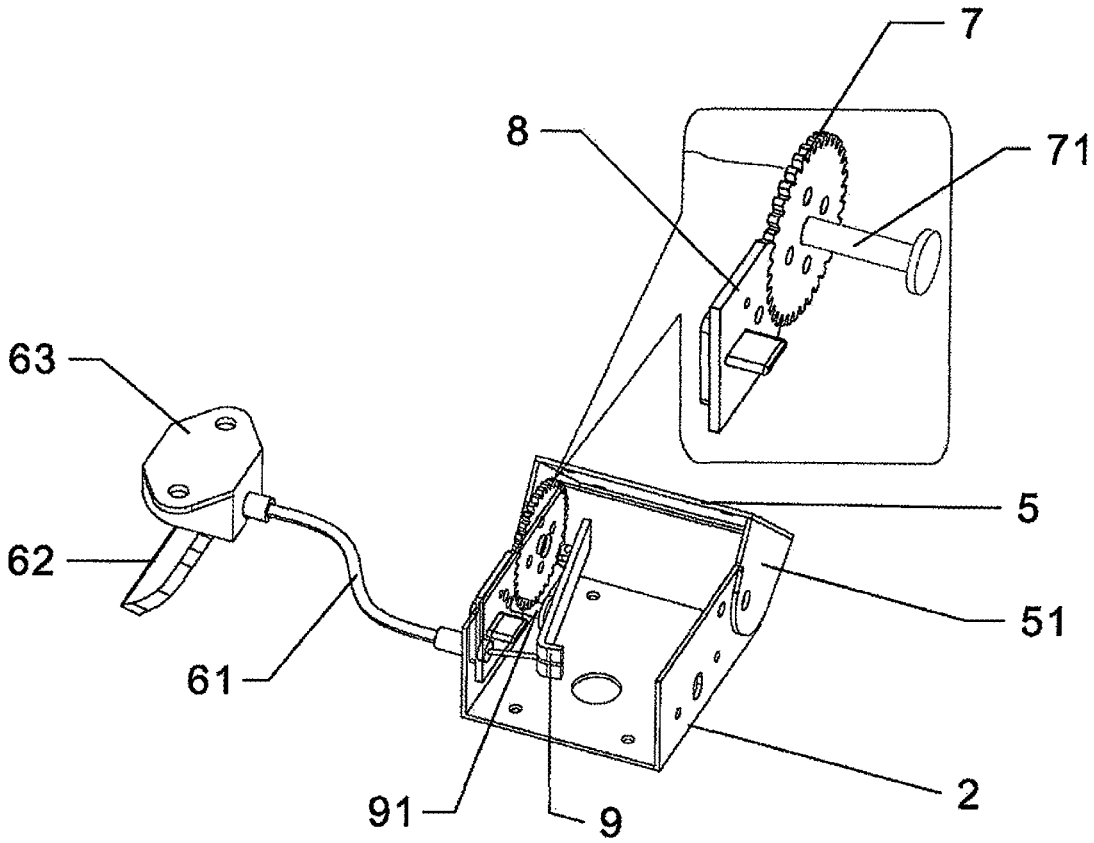
FIG. 2 is a schematic internal structural view of the shell of the present invention.
Figure 3:
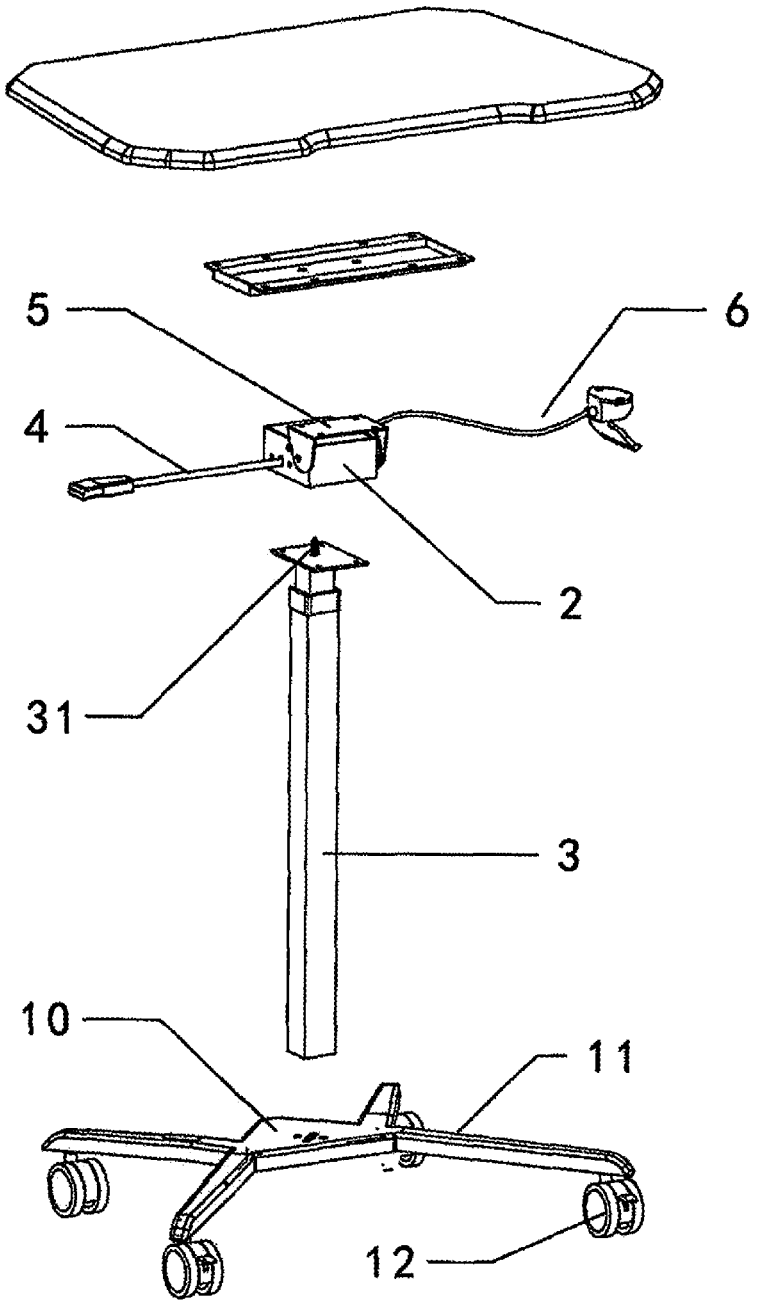
FIG. 3 is another structural view of the present invention.

As shown in FIGS. 1-3, an adjustment device that controls a tilting angle of a table top according to the present invention comprises a shell 2, a tilting piece 5, a gear 7, a position limiting piece 8 and a driving piece 9. The shell 2 is a rectangular box. The tilting piece 5 is adapted to connect with the table top; the tilting piece 5 has a sectional shape of an inverted U-shape. During connection, the tilting piece 5 is connected to the shell, covering a top front portion of the shell 2; a bended portion 51 is provided at each of two sides of the tilting piece 5, and each bended portion is provided with a pin hole through which a pin is inserted to connect the tilting piece with the shell and allows the tilting piece to rotate with respect to the shell. The gear 7 is provided on a left side of the shell 2; the gear 7 is fixedly connected with a corresponding bended portion 51 (one of the two bended portions 51); the tilting piece 5 and the gear 7 are connected with the corresponding side of the shell 2 through the pin 71 and pin holes on the tilting piece, the gear and the shell. As such, the tilting piece 5 and the gear 7 can be rotated synchronously on the shell 2. The tilting piece 5 rotates with respect to the shell 2 about a top front edge of the shell 2. The position limiting piece 8 is provided at a rear side of the gear 7; one end of the position limiting piece 8 is provided with a teethed portion that is capable of engaging with the gear 7 to limit rotation of the gear 7. The driving piece 9 is provided in an inclined manner inside the shell 2 such that the driving piece 9 has a proximal end and a far end with respect to the side of the shell where the gear and the position limiting piece are provided; the far end of the driving piece 9 is connected to one end of a control string 61; another end of the control string 61 is extended out of the shell 2; the proximal end of the driving piece 9 is attached to the an inner side wall of the shell corresponding to the side of the shell where the gear and the position limiting piece are provided. The driving piece 9 and the position limiting piece 8 are connected through a driving rod 91; the driving rod 91 also passes through the inner side wall of the shell corresponding to the side of the shell where the gear and the position limiting piece are provided, and the driving rod 91 drives the position limiting piece 8 to move so as to control engagement of the position limiting piece 8 with the gear 7. In operation, user can simply pull or release the control string to move the position limiting piece 8 via the driving piece 9; for example, when the control string is pulled, the position limiting piece 8 moves away from the gear 7 to disengage from the gear 7; in the other way round, when the control string is released, the position limiting piece 8 resets and engages again with the gear 7.

In a preferred embodiment, said another end of the control string 61 is provided with to string control handle; the string control handle comprises a hand-held portion 63 and a press portion 62; the press portion 62 is formed in a shape of a flat plate; an included angle is formed between a connecting part between the hand-held portion 63 and the press portion 62. The hand-held portion 63 facilitates holding of the same in a palm of the user, and the press portion 62 facilitates pressing operation by fingers. By squeezing under the cooperative force achieved by the palm and fingers of the user, pulling of the control string becomes effort-saving.

In a preferred embodiment, one side of the shell 2 is provided with a press handle 4, and a bottom part of the shell 2 is connected with a pneumatic cylinder 3. A top side of the pneumatic cylinder 3 is provided with a touch switch 31 which is positioned inside the shell 2 when the shell 2 and the pneumatic cylinder 3 are connected. The touch switch 31 corresponds to one end of the press handle 4 such that the press handle 4 can control touching with the touch switch 31 to control the up-down movement of the pneumatic cylinder 3.

In a preferred embodiment, a bottom part of the pneumatic cylinder 3 is connected to a supporting base. The supporting base has four legs 11 separated from one another, and each of the four legs 11 is provided with an omnidirectional wheel 12.

What is claimed is:

1. An adjustment device that controls a tilting angle of a table top, comprising a shell, characterized by also comprising a tilting piece, a gear, a position limiting piece and a driving piece; the tilting piece is provided at a top front portion of the shell and rotates about a top front edge of the shell; the gear is provided at one side of the shell; the gear is fixedly connected to a side portion of the tilting piece, and is rotatable synchronously with the tilting piece; the position limiting piece is provided at a rear side of the gear, and is provided with a teethed portion that is capable of engaging with the gear to limit rotation of the gear; the driving piece is provided in an inclined manner inside the shell such that the driving piece has a proximal end and a far end with respect to the side of the shell; the far end of the driving piece is connected to one end of a control string; the proximal end of the driving piece is attached to the an inner side wall of the shell corresponding to the side of the shell where the gear and the position limiting piece are provided; the driving piece and the position limiting piece are connected through a driving rod; the driving rod also passes through the inner side wall of the shell corresponding to the side of the shell where the gear and the position limiting piece are provided, and the driving rod drives the position limiting piece to move; another end of the control string is extended out of the shell adapted to be pulled or released by a user to move the position limiting piece through the driving piece and the driving rod to engage the position limiting piece with the gear or to move the position limiting piece away from the gear to disengage from the gear;

one side of the shell is provided with a press handle: a bottom part of the shell is connected with a pneumatic cylinder; a top side of the pneumatic cylinder is provided with a touch switch which is positioned inside the shell when the shell and the pneumatic cylinder are connected: the touch switch corresponds to one end of the press handle such that the press handle controls touching of said end of the press handle with the touch switch.

2. The adjustment device of claim 1, wherein said another end of the control string is provided with a string control handle; the string control handle comprises a hand-held portion; a press portion is connected to the hand-held portion to allow finger operation of the string control handle.

3. The adjustment device of claim 1, wherein the tilting piece has a sectional shape of an inverted U-shape.

4. The adjustment device of claim 1, wherein a bottom part of the pneumatic cylinder is connected to a supporting base; the supporting base has four legs separated from one another, and each of the four legs is provided with an omnidirectional wheel.

* * * * *